United States Patent [19]

Young

[11] Patent Number: 5,052,809

[45] Date of Patent: Oct. 1, 1991

[54] ROTARY DRIER

[75] Inventor: Francis M. Young, Waco, Tex.

[73] Assignee: Young Brothers, Inc., Waco, Tex.

[21] Appl. No.: 425,153

[22] Filed: Oct. 20, 1989

[51] Int. Cl.[5] ..... B01F 9/02; E01C 19/10; F26B 11/04

[52] U.S. Cl. ..... 366/25; 34/134; 34/137; 366/228

[58] Field of Search ..... 366/7, 22, 23, 24, 25, 366/147, 149, 219, 228, 233, 225; 34/31, 33, 60, 130, 132, 134, 135, 136, 137; 432/106, 107, 111, 112, 118, 14, 16, 18, 197, 108, 110; 165/104.19, 104.28, 104.29, 104.31, 177, 81, 82, 89; 126/434.5 A

[56] References Cited

U.S. PATENT DOCUMENTS

| | | | |
|---|---|---|---|
| 889,009 | 5/1908 | Holstein | 34/134 |
| 2,267,259 | 12/1941 | Adt | 34/137 X |
| 2,319,673 | 5/1943 | French | 432/107 X |
| 2,365,194 | 12/1944 | Hodson et al. | 432/14 X |
| 2,421,345 | 5/1947 | McConnaughay | 366/25 |
| 3,845,941 | 11/1974 | Mendenhall | 366/24 |
| 4,000,000 | 12/1976 | Mendenhall | 404/72 X |
| 4,105,396 | 8/1978 | Ritzmann | 432/14 |
| 4,212,850 | 7/1980 | Deussner | 432/14 X |
| 4,546,711 | 10/1985 | Kerwin | 432/14 X |
| 4,600,379 | 7/1986 | Elliott | 366/25 X |
| 4,612,711 | 9/1986 | Murray | 34/134 X |
| 4,787,938 | 11/1988 | Hawkins | 366/7 X |

FOREIGN PATENT DOCUMENTS

| | | | |
|---|---|---|---|
| 417825 | 8/1925 | Fed. Rep. of Germany | 432/111 |

*Primary Examiner*—Harvey C. Hornsby
*Assistant Examiner*—Scott J. Haugland
*Attorney, Agent, or Firm*—Diller, Ramik & Wight

[57] ABSTRACT

An asphalt plant which includes a drum having an axis of rotation, a mechanism for introducing materials into one end of the drum, a mechanism for discharging the materials from a second opposite end of the drum, and a heater for establishing a relatively high temperature zone through which the materials travel during drum rotation. A sinusoidal heat transfer tube is defined by opposing loops and conducts heat from the high temperature zone to the discharge end of the drum. The heat transfer tube thereby increases the efficiency of the asphalt plant by burning less fuel and more uniformly distributes heat throughout the drum, particularly at the discharge end thereof.

39 Claims, 3 Drawing Sheets

ROTARY DRIER

BACKGROUND OF THE INVENTION

The invention is directed to a rotary drier and specifically a drum asphalt plant which includes a rotatable drum into which is fed virgin aggregate, reclaimed asphalt and liquid asphalt which are admixed and heated to produce a finished asphalt (pavement) composition. The invention is specifically directed to a counterflow drier or a so-called double shell drum mixer in which the virgin aggregate and the reclaimed asphalt (millings, fines and sand) travel in a direction opposite to the direction of the hot gases normally generated by a combustion unit which burns natural gas or oil. The burner flame creates an extremely hot zone in the area of its discharge from the burner tube and the temperature progressively decreases toward the end of the drum into which the coarse aggregate and reclaimed asphalt is fed into the drum. At the discharge end of the drum which is downstream from the high temperature zone and essentially downstream and behind the burner flame, the temperature is appreciably reduced. Accordingly, in such asphalt plants there is an undesirable high temperature zone generally adjacent the burner flame, and an equally undesirable low temperature zone downstream of the burner flame at the discharge end of the drum. Desirably, a uniform temperature throughout the drum is optimally required, though practically and technically impossible, yet at a minimum it is highly desirable to heat the discharge end of lhe drum and, as best as possible, minimize extremes of high and low temperature zones.

In U.S. Pat. Nos. 3,845,941 issued Nov. 5, 1974 and 4,000,000 issued Dec. 28, 1976 in the name of Robert L. Mendenhall, efforts have been made at achieving uniformity of drum temperature by utilizing tubes positioned lengthwise of the drum through which hot air is conducted. However, in each of these drums the highest temperature is immediately at the discharge end of the drum which is undesirable, while the lowest temperature is at the entrance end of the drums. Because of this an excessive amount of heat/BTU's is introduced into the asphalt composition virtually immediately upon its discharge and thus is wasted whereas this heat/BTU's should more desirably be utilized initially to heat the incoming virgin aggregate and reclaimed asphalt. Accordingly, though uniformity of drum temperature is obviously desirable, such is not achieved, and whatever heat distribution is effected by the drums of these patents, such is obtained through excessively high heating of the asphalt composition/mixture immediately upon its discharge.

SUMMARY OF THE INVENTION

In keeping with the foregoing, the novel asphalt plant or drier of the present invention includes a drum having a first end into which is fed virgin aggregate and reclaimed asphalt and an opposite second end from which finished product (asphalt pavement/composition) or dried aggregate is discharged. A combustion unit is located at the second end of the drum and the burner tube thereof projects into the drum a considerable distance and directs a burner flame toward the first end of the drum. An extremely high temperature zone is created in the area of the burner flame which progressively reduces as the hot air/BTU's move toward the first end and is absorbed by the aggregate and the reclaimed asphalt.

In accordance with an important aspect of the present invention, a continuous sinusoidal heat conducting tube is disposed about a periphery of the drum through which a liquid medium is confined to flow. The heat conducting tube includes a plurality of interconnected tubular loops arranged in two series opening in generally opposite directions. A first of the two tubular loop series are disposed within a first zone of the drum immediately adjacent the burner flame and are exposed to the relatively high temperature thereof. A second series of the loops are disposed in the vicinity of the discharge end of the drum downstream of the flame and the high temperature zone created thereby. As the drum rotates, the fluid/liquid witin the tube is "pumped" and selectively flows in a direction opposite to drum rotation. In this fashion, liquid which is heated in the high temperature zone by the high heat/BTU's of the burner flame is conveyed through the tube to the discharge end and heats the latter through conduction/radiation. In this manner the high temperature zone adjacent the burner flame is proportionately reduced in temperature, whereas the discharge end of the drum is proportionately increased in temperature. Through the latter heat transfer mechanism, the overall efficiency of the drier is markedly increased, burner fuel consumption is reduced, and a more uniform and homogeneous asphalt/aggregater mix is the resultant end product.

DESCRIPTION OF THE PREFERRED EMBODIMENT

Figure 1:
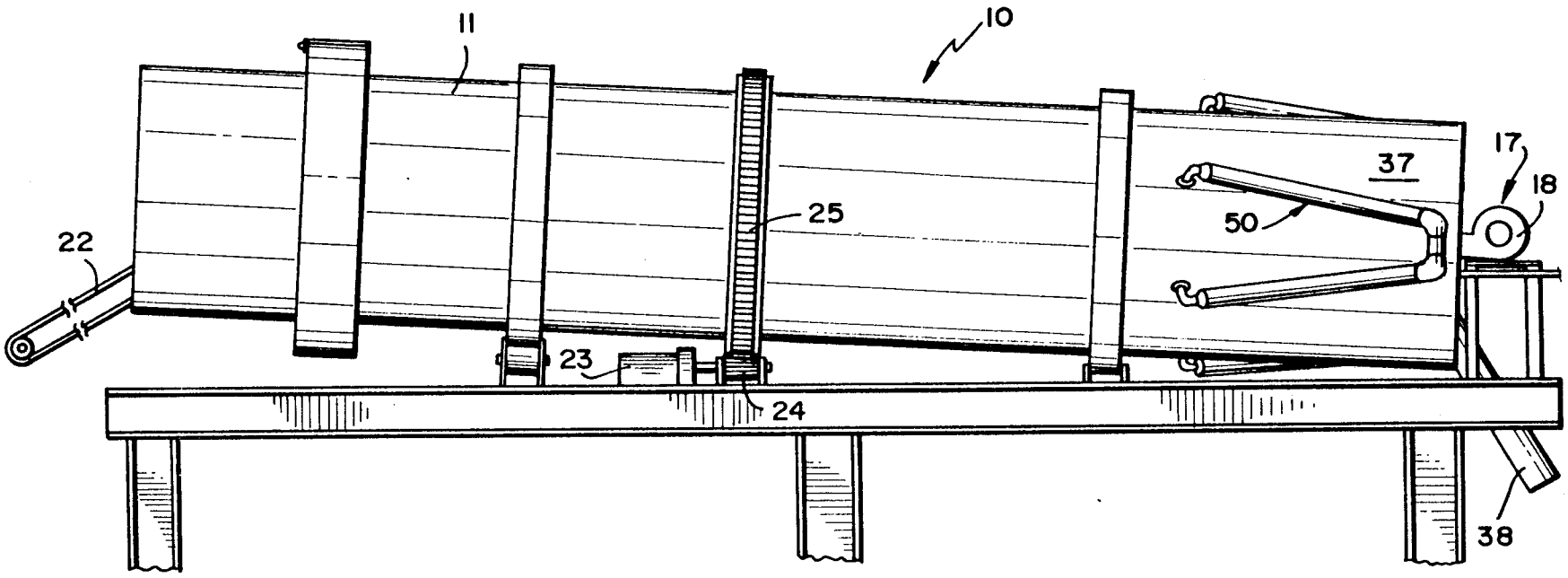
FIG. 1 is a side elevational view of a rotary asphalt drier constructed in accordance with this invention and illustrates a heat transfer mechanism in the form of a sinusoidal tube arranged circumferentially about a discharge end of the drier drum with loops of the tubing being positioned selectively inside and outside the drum.
Figure 2:
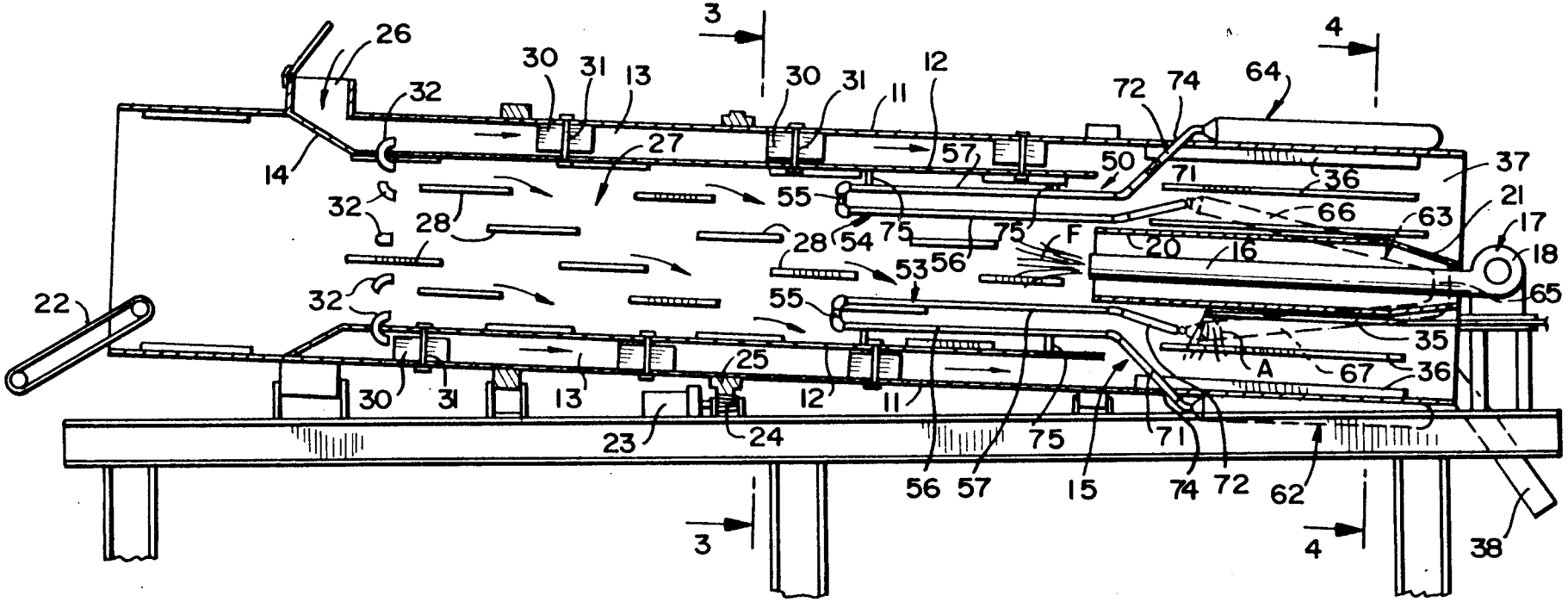
FIG. 2 is an axial cross sectional view through the rotary drier of FIG. 1, and illustrates various details thereof including the disposition of internally located loops of the tubing adjacent a combustion zone in which heat transfer liquid in the tubing is heated by the combustion gases of an associated burner flame.

A novel rotary asphalt drier is illustrated in FIGS. 1 and 2 of the drawings and is generally designated by the reference numeral 10.

The asphalt drier 10 is of the counterflow type which is also conventionally known as a double-shell drum mixer.

The asphalt drier 10 includes an outer metallic cylindrical shell 11, an inner cylindrical shell 12, and between the shells 11, 12 a jacket compartment 13 of a generally annular configuration closed at the left-hand end, as viewed in FIG. 2, by a frusto-conical wall 14. The inner shell 12 is open at an opposite end (unnumbered) which opens into an annular mixing chamber 15 in which coarse aggregate, reclaimed asphalt materials, sand, fines and liquid asphalt are mixed together in an area downstream from a flame F exiting from a burner tube or nozzle 16 of a combustion unit 17 which includes a conventional gas or oil fired burner (not shown) and a blower 18. The flame F and the gases of combustion flow from right to-left in FIGS. 1 and 2 under the influence of the blower 18 as secondary air is drawn into the inner shell 12 through a secondary air supply duct 20 having a frusto-conical open end 21.

Figure 4:
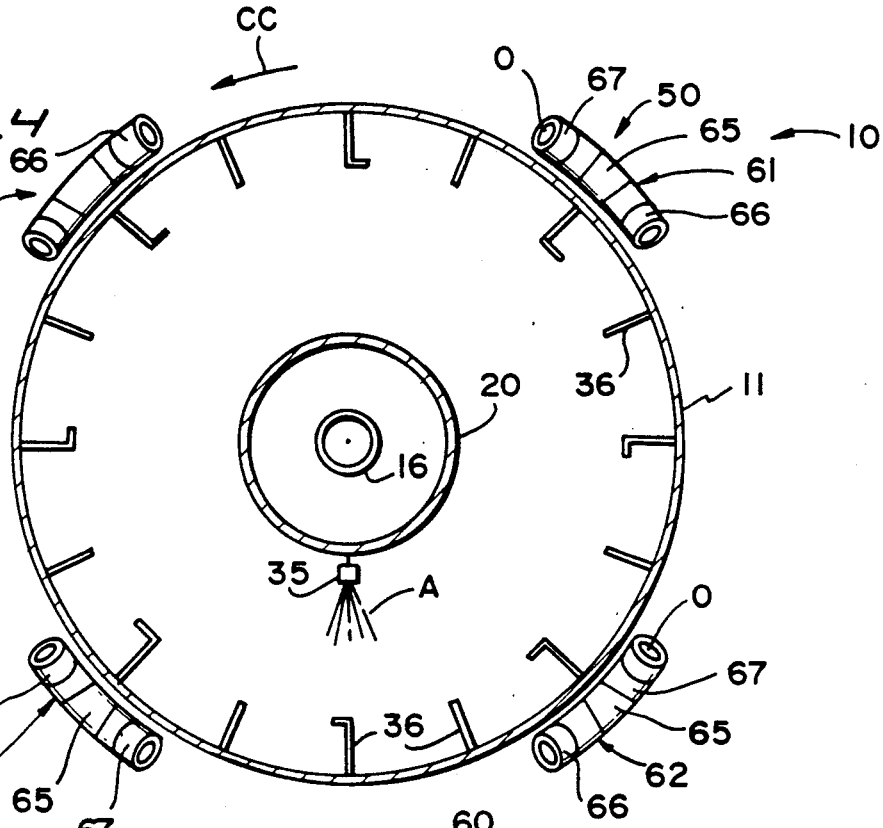
FIG. 4 is an enlarged cross sectional view taken generally along line 4—4 of FIG. 2, and illustrates the loops of the heat transfer tube which are located outside the drier.

Coarse virgin aggregate is fed into the inner shell 12 of the drier 10 by a conventional conveyer 22 during the rotation of the outer shell 11 by means of a motor 23 driving a beveled drive gear 24 which in turn drives a ring gear 25 fixed to the exterior of the outer shell 11. For purposes of this description it will be assumed that the drier 10 is rotated counterclockwise as viewed in FIGS. 3 and 4 of the drawings, as indicated by the headed arrow CC associated therewith. Reclaimed asphalt millings, fines and sand are introduced into the jacket compartment 13 through an inlet 26. The latter and the coarse aggregate flow from left-to-right in FIGS. 1 and 2, as indicated by the unnumbered headed arrows illustrated in FIG. 2. As the coarse aggregate moves from left-to-right through the inner shell I2 which essentially defines a cylindrical drum heating compartment 27, the aggregate is not only heated, but it is lifted and mixed by conventional flights or flight bars 28. The reclaimed asphalt millings, fines and sand are also admixed by conventional flights or flight bars 30 which are adjustably supported within the jacket compartment 13 by conventional bolts 31 which also secure the inner and outer shells 12, 11, respectively, in spaced relationship relative to each other. Hot combustion gases which are blown from right to left in FIG. 1 by the blower 10 are also directed by a plurality of heat induction tubes 32 into the jacket compartment 13 and flow from left-to-right therein.

As the reclaimed asphalt millings, fines, sand and coarse aggregate reach the right-hand end (unnumbered) of the inner shell 12, they are admixed in the annular chamber 15 during which time liquid asphalt A from a nozzle 35 is injected into the combined admixture as the latter is continuously subjected to admixing by further flight bars or flights 36 adjacent a discharge end 37 of the drier 10 from which the asphalt/aggregate mix or composition is discharged through a discharge chute 38.

The asphalt drier 10 thus far described is entirely of a conventional construction, and as can be best appreciated from FIG. 2, the very nature of the construction of the drier 10 creates areas or zones of differential heating and heat transfer. Characteristically, the area or zone of maximum temperature is the area or zone contiguous and to the left of the flame F in which the combustion gases are obviously the hottest. However, as the combustion gases flow to the left, the temperature thereof reduces as the coarse aggregate, initially at outside ambient temperature, is progressively heated during its movement from left-to-right. Obviously, the flame F and the combustion gases also directly heat the inner shell 12 which in turn heats the jacket compartment 13 along with the combustion gases directed into the jacket compartment 13 through the heat induction tubes 32. Combustion gases exit the left hand end of the drier 10 generally into a conventional dust collecting apparatus (not shown) and subsequently are either discharged to atmosphere or are recycled into the drier. However, these exhaust gases are relatively hot and. of course, the higher the BTU's the less efficient the overall process. Moreover, the coolest part of the overall drier is at the right hand end or discharge end 37 thereof simply because the air flow of the flame F and the combustion gases thereof under the influence of the blower 18 is to the left in FIG. 2. Hence, as the materials admix in the annular chamber 15 they also tend to cool. unless otherwise provided for, as in keeping with the present invention. Quite simplistically, the combustion zone in the area of the flame F can be considered a "hot spot" while to the right the entire discharge area 37 might be considered a "cool spot," relatively speaking. If the heat transfer from the flame F were more uniform throughout the length of the drier 10, particularly reducing the high temperature of the "hot spot" and increasing the temperature of the "cool spot," the overall efficiency of the drier 10 would increase.

In accordance with the present invention, means generally designated by the reference numeral 50, is provided for achieving heat transfer such as to effectively reduce the temperature of the "hot spot" by absorbing BTU's from the high temperature zone contiguous the burner flame F and transferring the absorbed BTU's to and dissipating the same at the "cool spot" in the area of the discharge end 37.

The heat transfer means 50 is a continuous generally sinusoidal closed tube disposed peripherally or circumferentially (FIG. 3) about the drier 10 selectively both internally and externally thereof which defines a closed sinusoidal path of travel for a heat transfer liquid, such as oil 0, between the high temperature zone adjacent-/contiguous the burner flame F and the low temperature zone at the discharge end 37 of the outer shell 1I.

The heat transfer tube 50 includes a plurality of interconnected generally tubular loops 51–54 (FIG. 3) and 61 64.

The loops 51–54 are located internally of the inner shell i2 and in a very high temperature zone near the flame F while the loops 61–64 are located externally of the outer shell 11. The loops 51–54 also "open" to the right, as viewed in FIG. 2, while the loops 61–64 open to the left, as is also viewed in FIG. 2. The diameter of the tubes 50 of the loops 51–54 is also larger than the diameter of the tubes 50 of the loops 61 64, as is best visualized in FIG. 3.

Each of the loops 51–54 includes a tubular bight 55 with each bight 55 being connected to a pair of tubular legs 56, 57 (FIG. 2) which can be in parallel relationship to each other but can diverge away from each other in a direction away from the associated tubular bight 55 and toward the right hand of the inner shell 12, as viewed in FIG. 2. Each of the loops 61–64 is defined by a bight 65 and legs 66, 67 which can also be parallel to each other but preferably diverge in a direction away from each other from right-to-left, as shown in FIG. 2. Each leg 56 of each loop 51–54 is connected to each leg 66 of each loop 61–64 by a transverse transition tube 71. Likewise, each leg 57 of each loop 51–54 is connected to each leg 67 by a tubular transverse transition tube 72. Preferably, though not necessarily, each leg 72 includes a ball check valve 73 which permits the heat transfer liquid 0 to flow in a clockwise direction, as viewed in FIG. 3, when the drier or drum 10 rotates counterclockwise CC, as is also best illustrated in FIG. 3. Obviously, the check valves 73 prevent flow in an opposite direction, as will be described more fully hereinafter. The transverse transition tubes 71, 72 pass through openings 74 in the outer shell 11 and suitable conventional sliding joints 75 connect the entire heat transfer means 50 to the outer shell 11 (FIGS. 2 and 3) and to the inner shell 12. Appropriate expansion joints (not shown) are also provided between the transverse transition tubes 71, 72 and the openings 74. The latter expansion joints and sliding connections are conventional and simply permit the heat transfer tube 50 to expand and contract when subjected to differential temperatures.

A conventional manually operated valved inlet 60 is provided in one of the transverse tubes 72 and a similar conventional manually operated valved outlet 70 is provided in one of the adjacent transverse tubes 71. Assuming that the drier or drum 10 is motionless and in the position shown in FIG. 3, a suitable hose connected to a source (not shown) of the heat transfer liquid 0, such as oil, is connected to the inlet 60 and the valve of the latter and the valve of the outlet 70 are manually moved to their open position. Oil is introduced into the inlet 60 and can only flow clockwise because of the check valves 73 and thus air exhausts from the outlet 70. When the heat transfer liquid 0 has reached the level L in FIG. 3. the valves of the inlet 60 and outlet 70 are manually closed and the hose is removed from the inlet 60. When thus charged with suitable heat transfer liquid 0 the asphalt drier 10 is ready for operation in the manner immediately hereinafter described.

OPERATION

In describing the operation of the asphalt plant or drier 10 it is assumed that the motor 23 is operative to drive the gears 24, 25 in appropriate directions to rotate the asphalt drier 10 counterclockwise (CC), as heretofore noted. Suitable coarse virgin aggregate and reclaimed asphalt, millings, fines and sand are introduced into the entrance or left-hand end of the outer shell 11 by the respective conveyor 22 and inlet 20. The natural gas or oil is ignited, the blower 18 is on and thus a flame F exits the nozzle 16 creating a normally high temperature zone immediately adjacent the area of the flame F which progressively reduces in temperature as the heat/BTU's are absorbed by the products moving left-to right through the inner shell 12 and cascading or agitating along the flights 28. The heat induction tubes 32 redirect the heat from the flame F from the inner shell into the jacket compartment 13 which, of course, preheats the reclaimed asphalt millings, fines and sand. All of these heated materials eventually reach the annular chamber 15 and it is within the annular chamber 15 that the coarse aggregate is combined and admixed with the reclaimed asphalt millings, fines, sand and liquid asphalt A injected by the nozzle 35. To this point the operation of the asphalt drier 10 is totally conventional.

Figure 3:
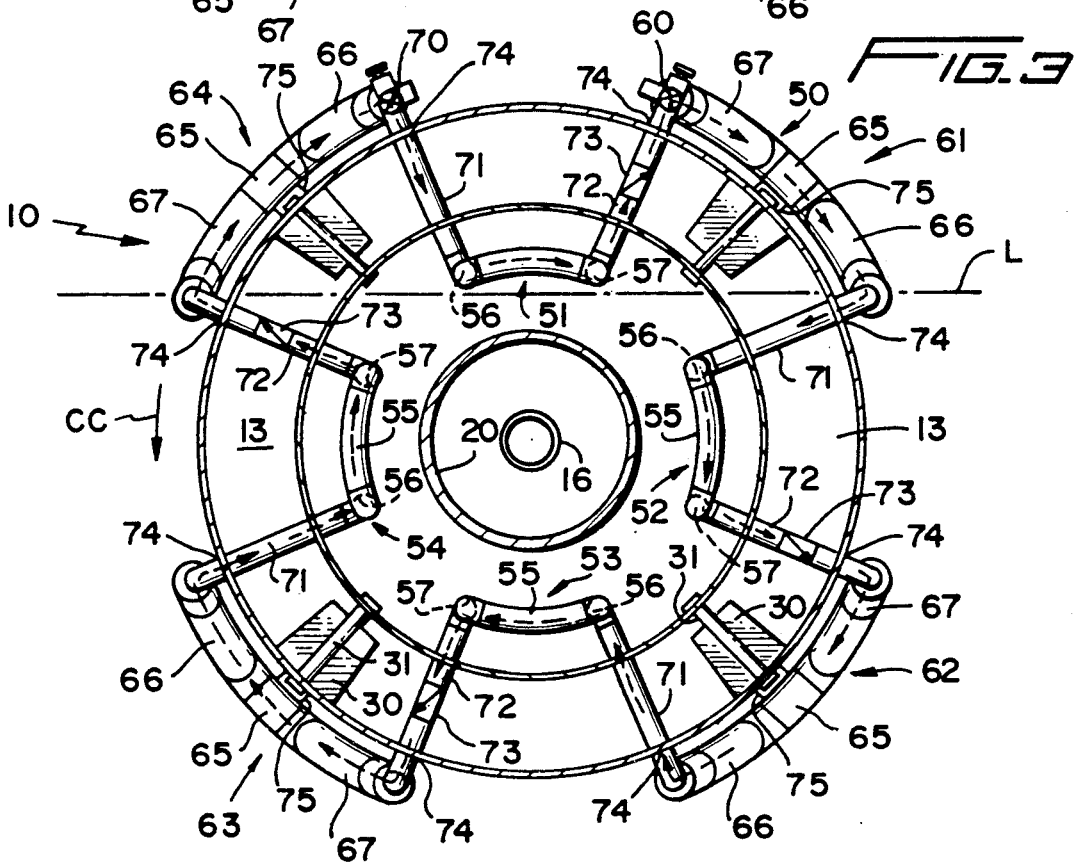
FIG. 3 is an enlarged cross sectional view taken generally along line 3—3 of FIG. 2, and illustrates the specific disposition of the sinusoidal heat transfer tube and the tubular portions located inside and outside the drier.

At the time that the asphalt drier or drum 10 is instantaneously at the position illustrated in FIG. 3, the tubes below the liquid level L are filled with heat transfer liquid 0 and the tubes above the liquid level L are simply filled with air. As the drier 10 rotates counterclockwise (CC), the leg 67 of the loop 64 progressively passes through the liquid level L and the transverse tube 71 between the loops 52, 61 progressively passes above the liquid level L. As the latter occurs the heat transfer liquid 0 in the tube 71 between the loops 52, 61 flows downwardly in the direction of the unnumbered headed arrow associated therewith simply because liquid seeks its own level and the liquid in the tube 71 attempts to maintain itself at the level L. Likewise, the heat transfer liquid 0 progressively enters and fills the leg 67 of the loop 65 displacing the air therein as the leg 67 progressively moves below the liquid level L. As the counterclockwise rotation of the drier 10 continues, the heat transfer liquid 0 progressively and subsequently totally fills the entire loop 64 when the loop 64 is beneath the liquid level L and, of course, the loop 52 is progressively emptied of the heat transfer liquid 0 as it progressively passes through and is totally above the liquid level L. Thus, as the asphalt drier 10 rotates counterclockwise (CC), all of the loops 51–54 and 61–64 systematically "pump" the heat transfer liquid 0 through the entire heat transfer tube 50, as is indicated by the unnumbered headed arrows associated therewith in FIG. 3. Accordingly, since the heat transfer liquid 0 continuously seeks its level and resists travelling above the liquid level line L, it will always progressively and continuously flow in a clockwise direction, as viewed in FIG. 3, as indicated by the unnumbered headed arrows associated with the heat transfer tube 50. In other words, the flow as described will be from the transverse tube 72 of the loop 54 into the leg 67, the bight 65 and the leg 66 of the loop 65, continuing through the transverse tube 71 to the leg 50 of the loop 51, flowing through the bight 55 to and through the leg 57 of the loop 51 and through the check valve 73 of the transverse leg 72 between the loops 51, 61. At this point in the counterclockwise rotation, the check valve 73 would, of course, be below the liquid level L. Reverse flow of the heat transfer liquid 0 is prevented by the check valve 73. In this fashion, as the asphalt plant or drier 10 rotates in the clockwise direction CC, the heat transfer liquid 0 moves continuously in a generally clockwise direction, as viewed in FIG. 3, progressively entering and exiting the successive loops and travelling in a sinusoidal pattern about the interior and exterior of the drum 10.

Considering again the "instantaneous" position of the drier 10 of FIG. 3, the heat transfer liquid 0 located in the loops 52–54 is subjected to the intense heat of the burner flame F because, of course, these loops are located immediately adjacent the burner flame F in the high temperature zone, as was described hereinafter and is clearly evident from FIG. 2. Thus, the heat/BTU's of the flame F are absorbed by the heat transfer liquid 0 in the loops 52 54. The temperature in the high temperature zone at the burner flame F is reduced and, due to the "pumping" of the heat transfer liquid 0 heretofore described, this extremely hot transfer liquid 0 is transferred by the "pumping" action to the exterior loops 61–64. More specifically, the hot heat transfer liquid 0 in the loop 54 is, as was earlier described, transferred or pumped into the loop 64 as the latter passes beneath the liquid level L. The loop 64 is, of course, as with the remaining loops 01–63, located exteriorly of the outer shell 11 and along the discharge end 37 thereof. Accordingly, the high temperature heat transfer liquid 0 gives up through conduction and radiation its BTU's and thereby heats the discharge end 37. In other words, as the loops 51–54 containing the heat transfer liquid or oil 0 progressively pass through the area of the burner F, the heat transfer oil 0 picks up the heat/BTU's thereof, and subsequently "pumps" or distributes this oil into and through the external loops 61 64 which through radiation and conduction dissipates this heat to the metallic outer shell 11 raising the temperature thereof. The latter thus desirably heats the finished product discharging the discharge end 37 through the discharge chute 38. Since the BTU's/heat are reduced in the intense heat zone contiguous to flame F, the totality of the heat introduced into the drier 10 is more evenly distributed throughout the length thereof, including most importantly, the discharge end 37, thereby increasing the efficiency by burning less natural gas or oil and more uniformly heating the combined aggregate/asphalt mix resulting in a better asphalt product.

Obviously, the one way ball check valves 73 prevent back flow of the heat transfer oil 0 as might occur if, for example, the speed of rotation of the drier drum 10 was quite high, although such check valves 73 are not required to achieve the continuous circulation of the oil 0 through the loops of the heat transfer mechanism 50 strictly under the pumping action created by the rotation of the drier 10. Furthermore, the invention is equally applicable to driers which rotate in a clockwise direction. Furthermore, the liquid level L of the oil may also be varied, but for maximum efficiency, there should be as much oil 0 in the heat transfer mechanism 50 as will provide maximum circulation at a predetermined speed of rotation of the drier 10 to afford maximum absorption of heat in the area of the loops 51–54 and maximum absorption of heat from the loops 61–64 at the discharge end 37 of the drier 10.

As was noted earlier herein, in the absence of the heat transfer means or tube 50 the admixed materials cool in the discharge area or end portion 37 and actually solidify and cake therein forming a relatively thick crust which is also a heat insulation barrier. Therefore, any heat that would otherwise conduct inwardly from the metallic outer shell 11 at the end portion 36 is impeded from doing so by the heat insulating admixed materials built up on the inner surface of the end portion 37. This obviously reduces heat transfer and automatically creates waste of material upon start-up, not to mention the fact that the same build-up or crust of the admixture reduces the effectiveness of the flight bars 37 because the axial depth thereof is reduced commensurate to the thickness of the build-up. However, due to the heat transfer tube or means 50, such build-up is prevented, material is not wasted upon start-up, and a superior asphalt product is produced.

Although a preferred embodiment of the invention has been specifically illustrated and described herein, it is to be understood that minor variations may be made in the apparatus and the method without departing from the spirit and scope of the invention as defined in the appended claims.

I claim:

1. A rotary drier comprising a drum having an axis of rotation, means for introducing material into said drum, means for discharging material from said drum, means for creating a flame in said drum for heating a first zone of said drum to a relatively high temperature which lessens to a lower temperature at a second zone of said drum spaced from said first zone, said second zone being located generally between said first zone and said material discharging means, means for rotating said drum to convey the material from the material introducing means to the material discharging means and through said first and second zones, and means for conducting a heated liquid along a closed path of travel between said first and second zones to extract heat created by the flame in said first zone and transfer the extracted heat to said second zone.

2. The rotary drier as defined in claim 1 wherein said heated liquid conducting means imparts a generally sinuous configuration to said path of travel.

3. The rotary drier as defined in claim 1, wherein said heated liquid conducting means imparts a generally sinuous configuration to said path of travel about a periphery of said drum.

4. The rotary drier as defined in claim 1 wherein said material discharging means is disposed in the vicinity of said second zone.

5. The rotary drier as defined in claim 1 wherein said heat conducting means includes a tube through which the heated liquid is adapted to flow.

6. The rotary drier as defined in claim 1 wherein said heat conducting means includes a tube through which the heated liquid is adapted to flow, and said tube is of a generally sinuous configuration disposed peripherally about said drum whereby rotation of said drum pumps the heated liquid through said tube.

7. The rotary drier as defined in claim 6 wherein said material discharging means is disposed in the vicinity of said second zone.

8. The rotary drier as defined in claim 7 wherein said heated liquid conducting means is located internally of said drum at said first zone and is located exteriorly of said drum at said second zone.

9. The rotary drier as defined in claim 6 wherein said heated liquid conducting means is located internally of said drum at said first zone and is located exteriorly of said drum at said second zone.

10. The rotary drier as defined in claim 1 wherein said heat conducting means includes a tube through which the heated liquid is adapted to flow, and said tube is of a generally sinuous configuration disposed peripherally about said drum whereby rotation of said drum in a predetermined direction pumps the heated liquid in a predetermined direction through said tube.

11. The rotary drier as defined in claim 1 wherein said heat conducting means includes a tube through which the heated liquid is adapted to flow, said tube is of a generally sinuous configuration disposed peripherally about said drum whereby rotation of said drum pumps the heated liquid through said tube, and valve means for limiting the flow of the heated liquid in only one direction.

12. The rotary drier as defined in claim 1 wherein said heat conducting means includes a tube through which the heated liquid is adapted to flow, said tube is of a generally sinuous configuration disposed peripherally about said drum whereby rotation of said drum in a predetermined direction pumps the heate dliquid in a predetermined direction through said tube, and valve means for limiting the flow of liquid to only said predetermined direction of liquid flow.

13. The rotary drier as defined in claim 1 wherein said heat conducting means includes a tube through which the heated liquid is adapted to flow, said tube is of a generally sinuous configuration disposed peripherally about said drum whereby rotation of said drum pumps the heated liquid through said tube, and check valve means for limiting the flow of liquid in only one direction.

14. The rotary drier as defined in claim 1 wherein said heat conducting means includes a tube through which the heated liquid is adapted to flow, said tube is of a generally sinuous configuration disposed peripherally about said drum whereby rotation of said drum in a predetermined direction pumps the heated liquid in a predetermined direction through said tube, and check valve means for limiting the flow of liquid to only said predetermined direction of liquid flow.

15. The rotary drier as defined in claim 1 wherein said heated liquid conducting means is located internally of said drum at said first zone and is located exteriorly of said drum at said second zone.

16. The rotary drier as defined in claim 1 wherein said rotating means rotates said drum in a predetermined direction to define a generally closed circular path of travel which includes an upwardly moving arcuate path portion and a downwardly moving arcuate path portion, said heat conducting means is a tube disposed about a periphery of said drum through which the heated liquid is adapted to flow, and means for preventing a fluid medium in the upwardly moving arcuate path portion from flowing upwardly.

17. The rotary drier as defined in claim 16 wherein said material discharging means is disposed in the vicinity of said second zone.

18. The rotary drier as defined in claim 17 wherein said heated liquid conducting means is located internally of said drum at said first zone and is located exteriorly of said drum at said second zone.

19. The rotary drier as defined in claim 16 wherein said heated liquid conducting means is located internally of said drum at said first zone and is located exteriorly of said drum at said second zone.

20. The rotary drier as defined in claim 1 wherein said rotating means rotates said drum in a predetermined direction to define a generally closed circular path of travel which includes an upwardly moving arcuate path portion and a downwardly moving arcuate path portion, said heat conducting means is a tube disposed about a periphery of said drum through which the heated liquid is adapted to flow, and valve means for preventing the heated liquid in the upwardly moving arcuate path portion from flowing upwardly.

21. The rotary drier as defined in claim 1 wherein said rotating means rotates said drum in a predetermined direction to define a generally closed circular path of travel which includes an upwardly moving arcuate path portion and a downwardly moving arcuate path portion, said heat conducting means is a tube disposed about a periphery of said drum through which the heated liquid is adapted to flow, and check valve means for preventing the heated liquid in the upwardly moving arcuate path portion from flowing upwardly.

22. The rotary drier as defined in claim 1 wherein said first zone is between said material introducing means and said material discharging means.

23. The rotary drier as defined in claim 1 wherein said first zone is located interiorly of said drum and the heated liquid conducting means is at least in part located exteriorly of said second zone.

24. The rotary drier as defined in claim 1 wherein said first zone is located interiorly of said drum and the heated liquid conducting means is at least in part located exteriorly of said second zone, and said heat conducting means passes through a wall of said drum.

25. The rotary drier as defined in claim 1 wherein said heat conducting means includes a tube through which the heated liquid is adapted to flow, said tube is of a generally sinuous configuration disposed peripherally about said drum whereby rotation of said drum pumps the heated liquid through said tube, said sinuous tube being defined by a plurality of interconnected tubular loops, said plurality of tubular loops being arranged in two series of tubular loops, and the loops of said two series open in generally opposite directions.

26. The rotary drier as defined in claim 25 wherein said material discharging means is disposed in the vicinity of said second zone.

27. The rotary drier as defined in claim 26 wherein said heated liquid conducting means is located internally of said drum at said first zone and is located exteriorly of said drum at said second zone.

28. The rotary drier as defined in claim 25 wherein said heated liquid conducting means is located internally of said drum at said first zone and is located exteriorly of said drum at said second zone.

29. The rotary drier as defined in claim 1 wherein said heat conducting means includes a tube through which the heated liquid is adapted to flow, said tube is of a generally sinuous configuration disposed peripherally about said drum whereby rotation of said drum pumps the heated liquid through said tube, said sinuous tube being defined by a plurality of interconnected tubular loops, said plurality of tubular loops being arranged in two series of tubular loops, the loops of said two series open in generally opposite directions, a first of said two tubular loop series is disposed in the vicinity of said first zone, and a second of said two tubular loop series is disposed in the vicinity of said second zone.

30. The rotary drier as defined in claim 1 wherein said heat conducting means includes a tube through which the heated liquid is adapted to flow, said tube is of a generally sinuous configuration disposed peripherally about said drum whereby rotation of said drum pumps the heated liquid through said tube, said sinuous tube being defined by a plurality of interconnected tubular loops, said plurality of tubular loops being arranged in two series of tubular loops, the loops of said two series open in generally opposite directions, a first of said two tubular loop series is disposed in the vicinity of said first zone, a second of said two tubular loop series is disposed in the vicinity of said second zone, and said first loop series is located internally of said drum.

31. The rotary drier as defined in claim 1 wherein said heat conducting means includes a tube through which the heated liquid is adapted to flow, said tube is of a generally sinuous configuration disposed peripherally about said drum whereby rotation of said drum pumps the heated liquid through said tube, said sinuous tube being defined by a plurality of interconnected tubular loops, said plurality of tubular loops being arranged in two series of tubular loops, the loops of said two series open in generally opposite directions, a first of said two tubular loop series is disposed in the vicinity of said first zone, a second of said two tubular loop series is disposed in the vicinity of said second zone, and said first loop series is located exteriorly of said drum.

32. The rotary drier as defined in claim 1 wherein said heat conducting means includes a tube through which the heated liquid is adapted to flow, said tube is of a generally sinuous configuration disposed peripherally about said drum whereby rotation of said drum pumps the heated liquid through said tube, said sinuous tube being defined by a plurality of interconnected tubular loops, said plurality of tubular loops being arranged in two series of tubular loops, the loops of said two series open in generally opposite directions, a first of said two tubular loop series is disposed in the vicinity of said first zone, a second of said two tubular loop series is disposed in the vicinity of said second zone, and said second loop series is located exteriorly of said drum.

33. The rotary drier as defined in claim 1 wherein said heat conducting means includes a tube through which the heated liquid is adapted to flow, said tube if of a generally sinuous configuration disposed peripherally about said drum whereby rotation of said drum pumps the heated liquid through said tube, said sinuous tube being defined by a plurality of interconnected tubular loops, said plurality of tubular loops being arranged in two series of tubular loops, the loops of said two series open in generally opposite directions, a first of said two tubular loop series is disposed in the vicinity of said first zone, a second of said two tubular loop series is disposed in the vicinity of said second zone, and said first loop series is located internally of said drum, said second loop series is located exteriorly of said dru, said first and second loop series include a tubular transition portion therebetween, and said tubular transition portion passes through a wall of said drufn.

34. The rotary drier as defined in claim 1 wherein said rotating means rotates said drum in a predetermined direction to define a generally closed circular path of travel which includes an upwardly moving arcuate path portion and a downwardly moving arcuate path portion, said heat conducting means is a tube disposed about a periphery of said drum through which the heated liquid is adapted to flow, means for preventing the heat liquid in the upwardly moving arcuate path portion from flowing upwardly, said tube is of a generally sinuous configuration peripherally about said drum whereby rotation of said drum pumps the heated liquid through said tube, said sinuous tube being defined by a plurality of interconnected tubular loops, said plurality of tubular loops being arranged in two series of tubular loops, and the loops of said two series open in generally opposite directions.

35. The rotary drier as defined in claim 1 wherein said rotating means rotates said drum in a predetermined direction to define a generally closed circular path of travel which includes an upwardly moving arcuate path portion and a downwardly moving arcuate path portion, said heat conducting means is a tube disposed about a periphery of said drum through which the heated liquid is adapted to flow, means for preventing the heat liquid in the upwardly moving arcuate path portion from flowing upwardly, said tube is of a generally sinuous configuration peripherally about said drum whereby rotation of said drum pumps the heated liquid through said tube, said sinuous tube being defined by a plurality of interconnected tubular loops, said plurality of tubular loops being arranged in two series of tubular loops, and the loops of said two series open in generally opposite directions, a first of said two tubular loop series is disposed in the vicinity of said first zone, and a second of said two tubular loop series is disposed in the vicinity of said second zone.

36. The rotary drier as defined in claim 1 wherein said rotating means rotates said drum in a predetermined direction to define a generally closed circular path of travel which includes an upwardly moving arcuate path portion and a downwardly moving arcuate path portion, said heat conducting means is a tube disposed about a periphery of said drum through which the heated liquid is adapted to flow, means for preventing the heat liquid in the upwardly moving arcuate path portion from flowing upwardly, said tube is of a generally sinuous configuration peripherally about said drum whereby rotation of said drum pumps the heated liquid through said tube, said sinuous tube being defined by a plurality of interconnected tubular loops, said plurality of tubular loops being arranged in two series of tubular loops, and the loops of said two series open in generally opposite directions, a first of said two tubular loop series is disposed in the vicinity of said first zone, a second of said two tubular loop series is disposed in the vicinity of said second zone, and said first loop series is located internally of said drum.

37. The rotary drier as defined in claim 1 wherein said rotating means rotates said drum in a predetermined direction to define a generally closed circular path of travel which includes an upwardly moving arcuate path portion and a downwardly moving arcuate path portion, said heat conducting means is a tube disposed about a periphery of said drum through which the heated liquid is adapted to flow, means for preventing the heat liquid in the upwardly moving arcuate path portion from flowing upwardly, said tube is of a generally sinuous configuration peripherally about said drum whereby rotation of said drum pumps the heated liquid through said tube, said sinuous tube being defined by a plurality of interconnected tubular loops, said plurality of tubular loops being arranged in two series of tubular loops, and the loops of said two series open in generally opposite directions, a first of said two tubular loop series is disposed in the vicinity of said first zone, a second of said two tubular loop series is disposed in the vicinity of said second zone, and said second loop series is located exteriorly of said drum.

38. The rotary drier as defined in claim 1 wherein said rotating means rotates said drum in a predetermined direction to define a generally closed circular path of travel which includes an upwardly moving arcuate path portion and a downwardly moving arcuate path portion, said heat conducting means is a tube disposed about a periphery of said drum through which the heated liquid is adapted to flow, means for preventing the heat liquid in the upwardly moving arcuate path portion from flowing upwardly, said tube is of a generally sinuous configuration peripherally about said drum whereby rotation of said drum pumps the heated liquid through said tube, said sinuous tube being defined by a plurality of interconnected tubular loops, said plurality of tubular loops being arranged in two series of tubular loops, and the loops of said two series open in generally opposite directions, a first of said two tubular loop series is disposed in the vicinity of said first zone, a second of said two tubular loop series is disposed in the vicinity of said second zone, and said second loop series is located exteriorly of said drum.

39. The rotary drier as defined in claim 1 wherein said rotating means rotates said drum in a predetermined direction to define a generally closed circular path of travel which includes an upwardly moving arcuate path portion and a downwardly moving arcuate path portion, said heat conducting means is a tube disposed about a periphery of said drum through which the heated liquid is adapted to flow, means for preventing the heat liquid in the upwardly moving arcuate path portion from flowing upwardly, said tube is of a generally sinuous configuration peripherally about said drum whereby rotation of said drum pumps the heated liquid through said tube, said sinuous tube being defined by a plurality of interconnected tubular loops, said plurality of tubular loops being arranged in two series of tubular loops, and the loops of said two series open in generally opposite directions, a first of said two tubular loop series is disposed in the vicinity of said first zone, a second of said two tubular loop series is disposed in the vicinity of said second zone, said first loop series is located internally of said drum, said second loop series is located exteriorly of said drum, said first and second loop series include a tubular transition portion therebetween, and said tubular transition portion passes through a wall of said drum.

* * * * *